US011060753B2

(12) United States Patent
Kojima et al.

(10) Patent No.: US 11,060,753 B2
(45) Date of Patent: Jul. 13, 2021

(54) AIR-CONDITIONING SYSTEM

(71) Applicant: DAIKIN INDUSTRIES, LTD., Osaka (JP)

(72) Inventors: Nobuyuki Kojima, Osaka (JP); Ryouta Suhara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 132 days.

(21) Appl. No.: 16/072,943

(22) PCT Filed: Dec. 12, 2016

(86) PCT No.: PCT/JP2016/086896

§ 371 (c)(1),
(2) Date: Jul. 26, 2018

(87) PCT Pub. No.: WO2017/149894

PCT Pub. Date: Sep. 8, 2017

(65) Prior Publication Data

US 2019/0041083 A1 Feb. 7, 2019

(30) Foreign Application Priority Data

Mar. 2, 2016 (JP) ..... JP2016-039636

(51) Int. Cl.
*F24F 11/00* (2018.01)
*F24F 11/89* (2018.01)
(Continued)

(52) U.S. Cl.
CPC ..... *F24F 11/89* (2018.01); *F24F 1/0014* (2013.01); *F24F 11/79* (2018.01); *F24F 13/14* (2013.01); *F24F 1/0047* (2019.02); *F24F 1/02* (2013.01)

(58) Field of Classification Search
CPC ..... F24F 11/89; F24F 11/79; F24F 1/0014; F24F 13/14; F24F 1/0047; F24F 1/02
See application file for complete search history.

(56) References Cited

U.S. PATENT DOCUMENTS 8,229,599 B2 * 7/2012 Nishino ..... F24F 11/30 700/282
10,054,328 B2 * 8/2018 Kobori ..... F24F 11/30
2010/0010680 A1 * 1/2010 Nishino ..... F24F 9/00 700/282

FOREIGN PATENT DOCUMENTS

JP 7-27395 A 1/1995
JP 11-118179 A 4/1999
(Continued)

OTHER PUBLICATIONS

International Search Report for PCT/JP2016/086896 dated Mar. 7, 2017.

(Continued)

*Primary Examiner* — Eldon T Brockman
(74) *Attorney, Agent, or Firm* — Birch, Stewart, Kolasch & Birch, LLP

(57) ABSTRACT

A draft perceived by a user under an indoor unit is reduced. A controller makes each of a plurality of indoor units perform a partial supply operation. In the partial supply operation, the controller controls an airflow blocking mechanism such that, regarding the indoor units adjacent to each other with a predetermined distance α interposed therebetween, no air current is blown from one of the outlet openings which face each other with the predetermined distance α interposed therebetween.

4 Claims, 13 Drawing Sheets

(51) Int. Cl.

| | |
|---|---|
| ***F24F 11/79*** | (2018.01) |
| ***F24F 1/0014*** | (2019.01) |
| ***F24F 13/14*** | (2006.01) |
| *F24F 1/0047* | (2019.01) |
| *F24F 1/02* | (2019.01) |

(56) References Cited

FOREIGN PATENT DOCUMENTS

| | | | |
|---|---|---|---|
| JP | 2008-116064 | A | 5/2008 |
| JP | 2011-69594 | A | 4/2011 |
| JP | 2012-184868 | A | 9/2012 |

OTHER PUBLICATIONS

Extended European Search Report dated Sep. 11, 2019 in corresponding European Application No. 16892729.1.

* cited by examiner

AIR-CONDITIONING SYSTEM

TECHNICAL FIELD

The present invention relates to an air-conditioning system.

BACKGROUND ART

Systems, such as the system disclosed in Patent Document 1, have been known. In Patent Document 1, a plurality of indoor units are embedded in the ceiling of the same room. A conditioned air current is supplied into the same room from each of the indoor units. In particular, in Patent Document 1, the direction and volume of the air current supplied from each indoor unit are controlled to optimize a temperature distribution in the room.

CITATION LIST

Patent Document

Patent Document 1: Japanese Unexamined Patent Publication No. H7-27395

SUMMARY OF THE INVENTION

Technical Problem

Some types of ceiling-mounted indoor units are configured to be able to blow air currents in a plurality of directions, e.g., in four directions. Suppose that such indoor units are installed in the ceiling of the same room so as to be arranged at a predetermined distance apart from one another in the horizontal direction. If the indoor units adjacent to each other with the predetermined distance interposed therebetween blow air currents from two outlet openings which face each other with the predetermined distance interposed therebetween, the air currents collide with each other and are forced to flow downward. These air currents flowing downward may be blown directly on a user under the indoor units. These air currents may be perceived as a draft by the user.

The present invention is therefore intended to provide an air-conditioning system which has a plurality of indoor units mounted in a ceiling, and which may reduce a draft perceived by a user under the indoor units.

Solution to the Problem

The first aspect of the present disclosure includes: a plurality of indoor units (10) installed in a ceiling (501) of an indoor space (500), the plurality of indoor units (10) each having an indoor casing (20) provided with a plurality of outlet openings (24*a* to 24*d*), and an airflow blocking mechanism (50) provided at each of the outlet openings (24*a* to 24*d*) and configured to block an air current; and a controller (70) which controls the airflow blocking mechanism (50) in order to perform a partial supply operation in which, in each of the indoor units (10), the air current coming from one or some of the outlet openings (24*a* to 24*d*) is blocked by the airflow blocking mechanism (50), thereby increasing a speed of the air current coming from the rest of the outlet openings (24*a* to 24*d*). In the partial supply operation, the controller (70) controls the airflow blocking mechanism (50) such that, regarding the indoor units (10) adjacent to each other with a predetermined distance interposed therebetween, no air current is blown from one of the outlet openings (24*a* to 24*d*) which face each other with the predetermined distance interposed therebetween.

According to the above-described indoor units (10) adjacent to each other, no air current is blown into the indoor space (500) from one of main outlet openings (24*a* to 24*d*) which face each other with the predetermined distance $\alpha$ interposed therebetween, whereas an air current is blown into the indoor space (500) from the other main outlet opening. Thus, air currents are not blown from two outlet openings (24*a* to 24*d*) which face each other with the predetermined distance $\alpha$ interposed therebetween. Therefore, the air currents do not collide with each other and are not forced to flow downward. This configuration reduces the possibility that the air currents forced to flow downward is blown directly on a user under the indoor units (10). It is therefore possible to reduce a draft perceived by the user.

A second aspect of the present disclosure is an embodiment of the first aspect. In the second aspect, each of the indoor units (10) further has an airflow direction adjusting flap (51) provided at a corresponding one of the outlet openings (24*a* to 24*d*) and configured to change a direction of air blown from the corresponding one of the outlet openings (24*a* to 24*d*). The controller (70) controls the airflow blocking mechanism (50) and the airflow direction adjusting flap (51) in order to perform an airflow rotation in which a full supply operation supplying air to the indoor space (500) from all of the outlet openings (24*a* to 24*d*) and the partial supply operation are alternately performed.

During the partial supply operation of the airflow rotation, no air current is blown from one of outlet openings (24*a* to 24*d*) which face each other with the predetermined distance $\alpha$ interposed therebetween, whereas the air current is blown from the other outlet opening. In this configuration, air currents are not blown from the outlet openings (24*a* to 24*d*) which face each other with the predetermined distance $\alpha$ interposed therebetween. Thus, the air currents do not merge with each other, which reduces the possibility that the air currents are blown directly on a user under the indoor units (10). Further, the airflow rotation including the partial supply operation and the full supply operation allows the conditioned air to be supplied to an area in the indoor space (500) which is relatively close to the indoor unit (10) and an area in the indoor space (500) which is relatively far from the indoor unit (10). A difference in the temperature among areas in the indoor space (500) can thus be reduced.

A third aspect of the present disclosure is an embodiment of the second aspect. In the third aspect, the airflow direction adjusting flap (51) is capable of shifting to a position where the air current blown from the corresponding one of the outlet openings (24*a* to 24*d*) is blocked, and also serves as the airflow blocking mechanism.

In this aspect, the airflow direction adjusting flap (51) for changing the direction of the supply airflow in the vertical direction also serves as an airflow blocking mechanism (50) for blocking the flow of air. That is, the airflow direction adjusting flap (51) taking a predetermined position blocks the air coming from the outlet openings (24*a* to 24*d*)

A fourth aspect of the present disclosure is an embodiment of the third aspect. In the fourth aspect, the airflow direction adjusting flap (51) closes the corresponding one of the outlet openings (24*a* to 24*d*) in the partial supply operation.

In this configuration, air is not blown from the closed outlet opening (24*a* to 24*d*) in the partial supply operation with reliability.

A fifth aspect of the present disclosure is an embodiment of any one of the first to fourth aspects. In the fifth aspect, the indoor casing (20) of each of the indoor units (10) has a rectangular lower surface (22). The main outlet openings (24*a* to 24*d*) are arranged such that one main outlet opening is provided along one of four sides of the lower surface (22).

Advantages of the Invention

According to an aspect of the present disclosure, air currents are not blown from two outlet openings (24*a* to 24*d*) which face each other with the predetermined distance α interposed therebetween, and therefore not forced to flow downward as a result of collision of the air currents. This configuration therefore avoids the possibility that the air currents forced to flow downward is blown directly on a user under the indoor units (10). It is therefore possible to reduce a draft perceived by the user.

Particularly according to the second aspect, air currents are not blown from two outlet openings (24*a* to 24*d*) which face each other with the predetermined distance α interposed therebetween in the partial supply operation. Thus, the air currents do not merge with each other, which reduces the possibility that the air currents are blown directly on a user under the indoor units (10). Further, the airflow rotation including the partial supply operation and the full supply operation allows the conditioned air to be supplied to an area in the indoor space (500) which is relatively close to the indoor unit (10) and an area in the indoor space (500) which is relatively far from the indoor unit (10). A difference in the temperature among areas in the indoor space (500) can thus be reduced.

Particularly according to the third aspect, the airflow direction adjusting flap (51) taking a predetermined position may block the air coming from the outlet opening (24*a* to 24*d*) in the partial supply operation.

Particularly according to the fourth aspect, air is not blown from the closed outlet opening (24*a* to 24*d*) in the partial supply operation with reliability.

DESCRIPTION OF EMBODIMENTS

Embodiments of the present disclosure will now be described in detail with reference to the drawings. The embodiments described below are merely exemplary ones in nature, and are not intended to limit the scope, applications, or use of the invention.

Embodiment

—General Description of Air-Conditioning System—

Figure 1:
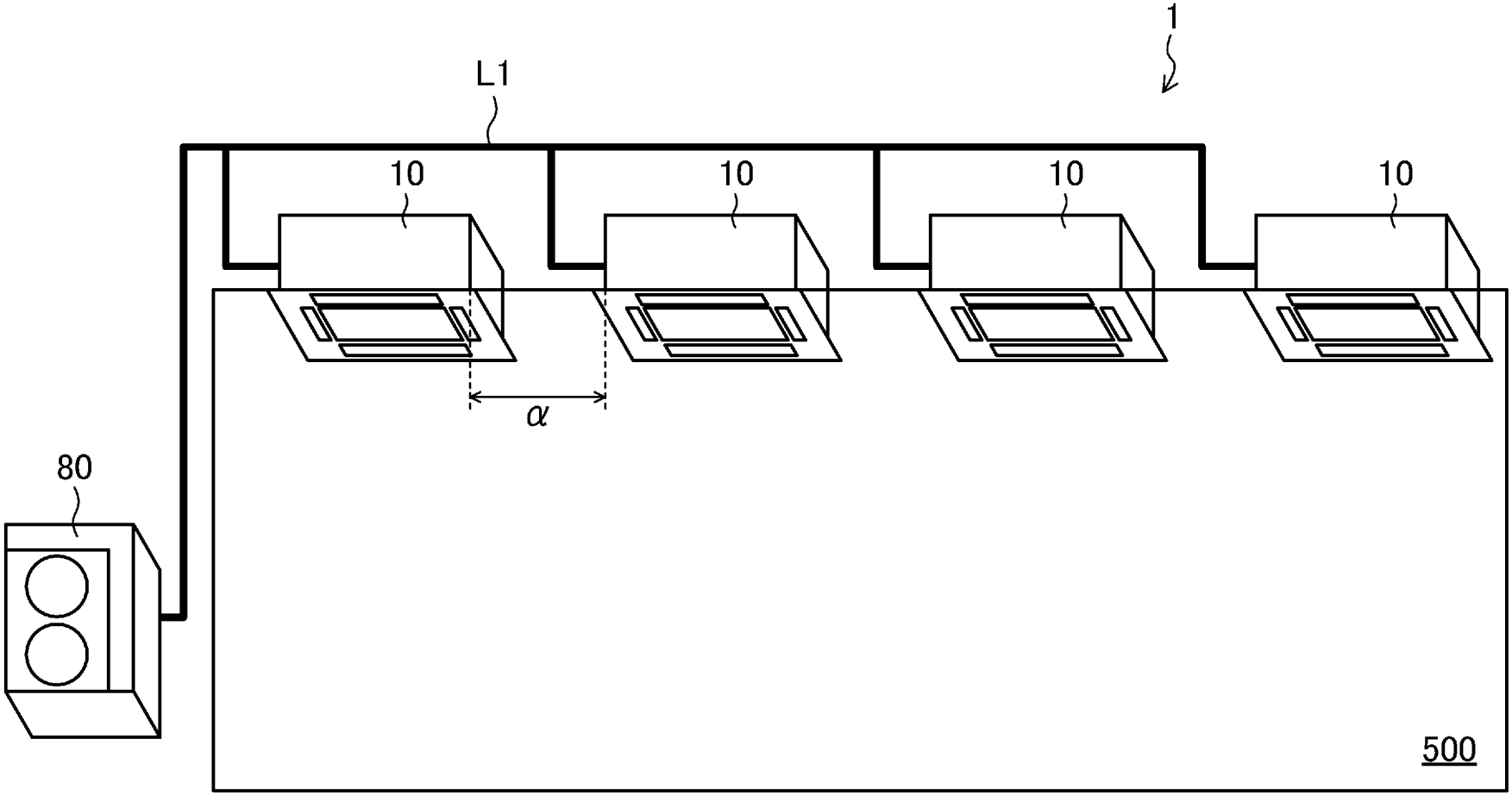
FIG. 1 is a diagram illustrating an external view of an air-conditioning system which has a plurality of indoor units installed in one indoor space.
Figure 6:
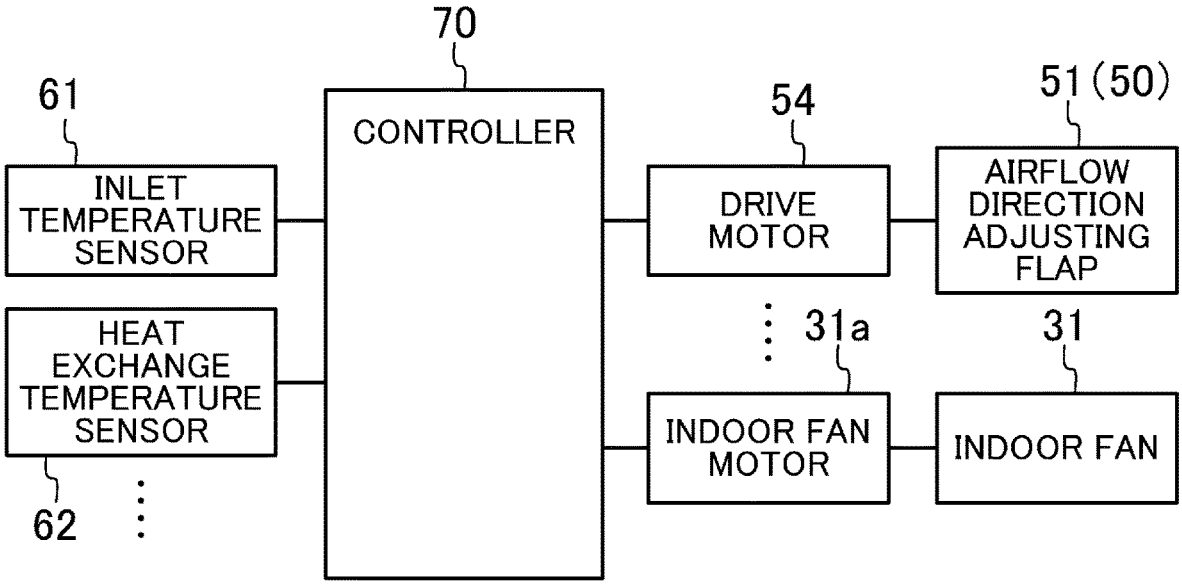
FIG. 6 is a block diagram schematically illustrating a controller and various devices connected to the controller.

An air-conditioning system (1) according to the present embodiment includes a plurality of indoor units (10) connected to one outdoor unit (80), in which an airflow direction adjusting flap (51) of each of the indoor units (10) is controlled. As illustrated in FIGS. 1 and 6, the air-conditioning system (1) includes a plurality of indoor units (10), one outdoor unit (80), and a controller (70). Each of the indoor units (10) is connected to the outdoor unit (80) by a communication pipe (L1), thereby forming a refrigerant circuit in which a refrigerant circulates to perform a refrigeration cycle.

Each of the plurality of indoor units (10) is embedded in the ceiling of the indoor space (500). The indoor units (10) are spaced from each other by a predetermined distance α in the horizontal direction, and supplies air into the indoor space (500). In the present embodiment, the indoor units (10) have the same configuration, which will be described later.

The outdoor unit (80) is placed outside the indoor space (500). Although not shown, the outdoor unit (80) includes a compressor, an outdoor fan, and other components.

The controller (70) is a microcomputer comprised, for example, of a CPU for computations and a memory for storing data, and is configured to control operation of each of the plurality of indoor units (10) and one outdoor unit (80). In the present embodiment, the manner in which the controller (70) is arranged is not particularly limited. The controller (70) may be configured as controllers independently provided in the indoor units (10) and the outdoor unit (80), or may be configured as a device independent from the indoor units (10) and the outdoor unit (80).

The controller (70) may be further provided with a dip switch used by an installation operator or a maintenance operator to set operation of the controller (70).

—Configuration of Indoor Unit—

As illustrated in FIGS. 1 to 5, the indoor unit (10) has a casing (20) (which corresponds to an indoor casing), an indoor fan (31), an indoor heat exchanger (32), a drain pan (33), a bell mouth (36), and an airflow direction adjusting flap (51).

<Casing>

Figure 2:
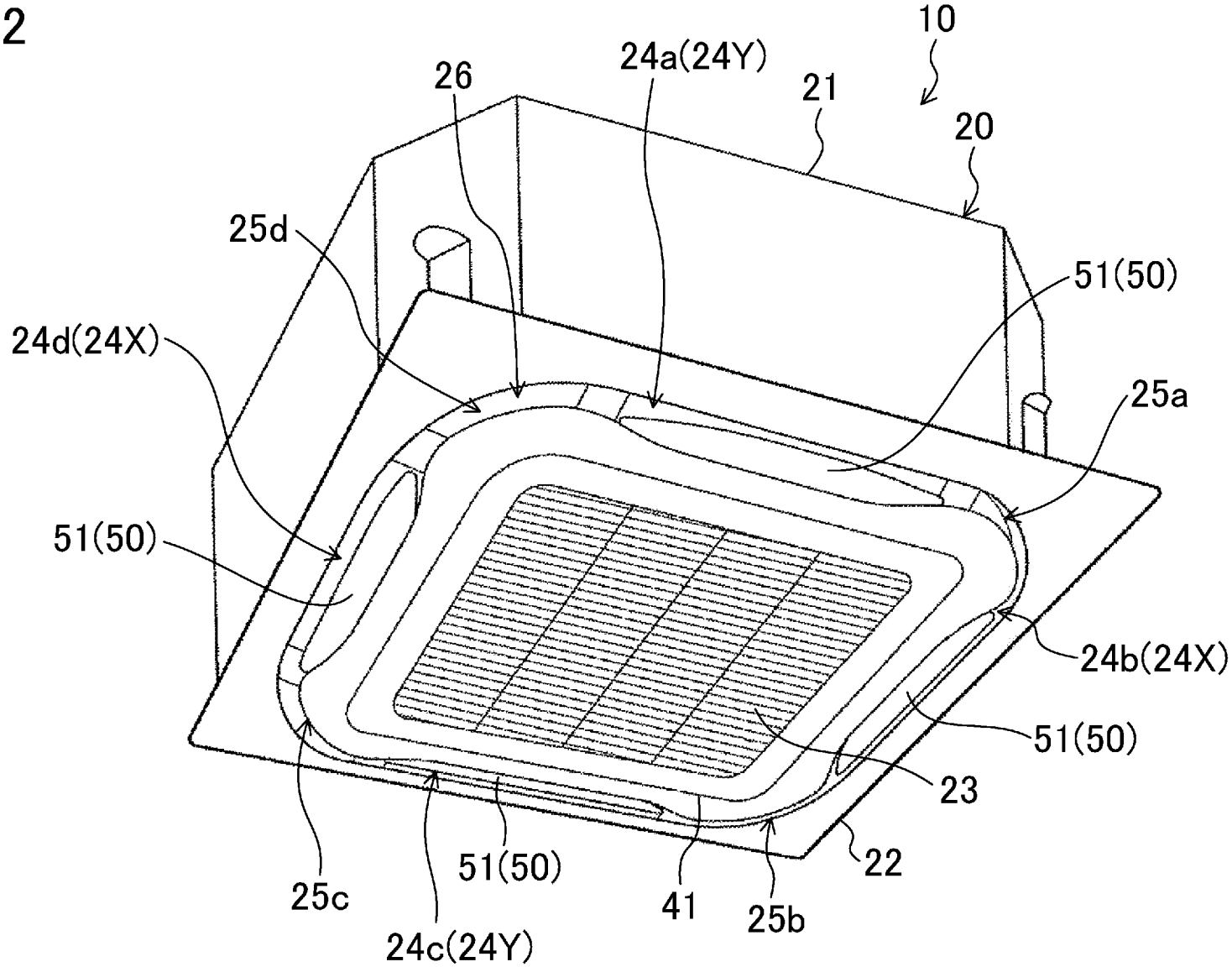
FIG. 2 is a diagram illustrating a perspective view of an indoor unit viewed obliquely from below.

As illustrated in FIG. 2, the casing (20) is provided in a ceiling (501) of the indoor space (500). The casing (20) is comprised of a casing body (21) and a decorative panel (22). The casing (20) houses the indoor fan (31), the indoor heat exchanger (32), the drain pan (33), and the bell mouth (36).

Figure 4:
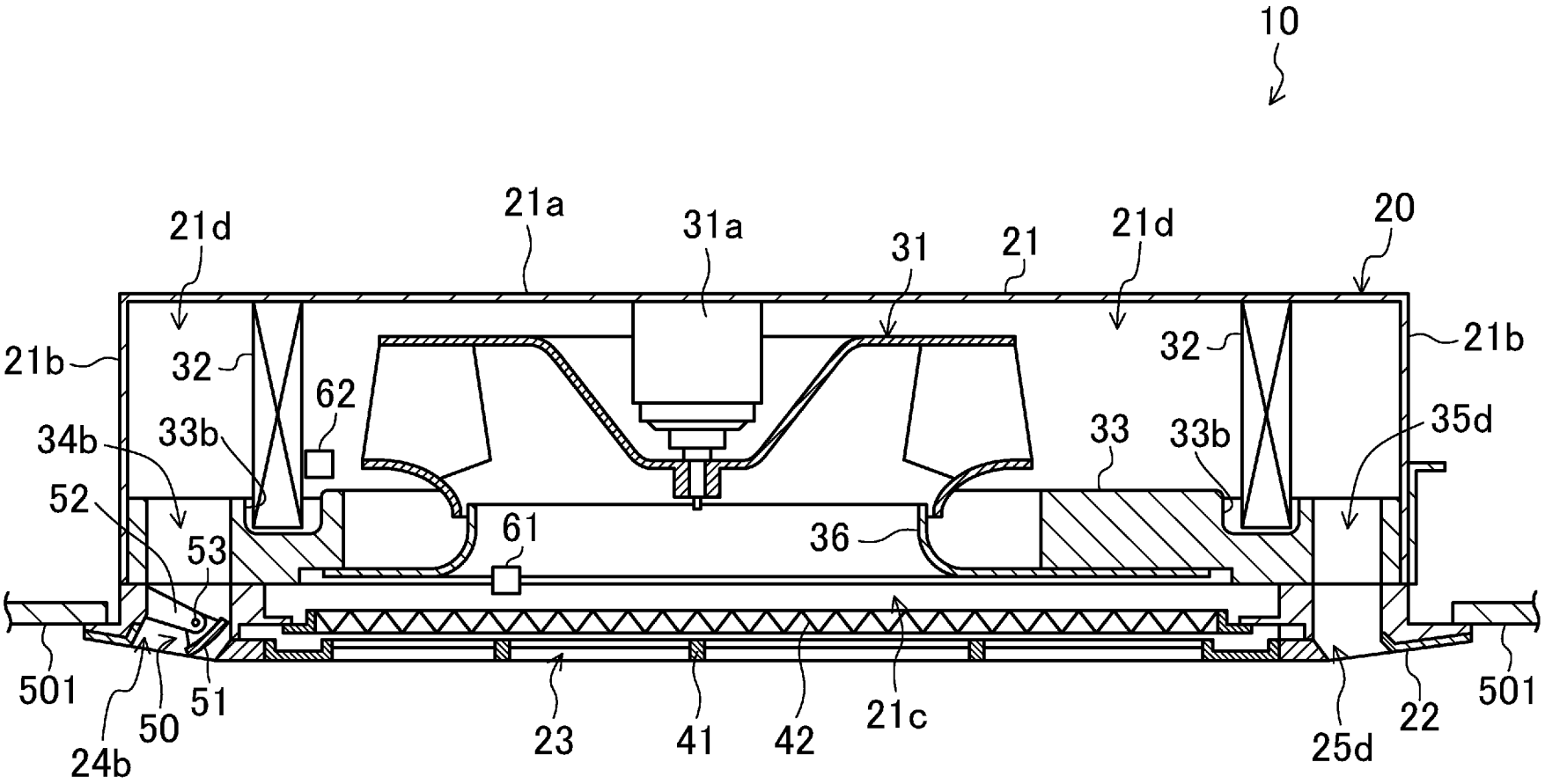
FIG. 4 is a diagram generally illustrating a cross-sectional view of the indoor unit taken along the line IV-O-IV shown in FIG. 3.

The casing body (21) is inserted in an opening of the ceiling of the indoor space (500). The casing body (21) has a generally rectangular parallelepiped box-like shape with its lower end open. As illustrated in FIG. 4, the casing body (21) includes a generally flat top panel (21*a*), and a side panel (21*b*) extending downward from a peripheral portion of the top panel (21*a*).

<Indoor Fan>

The indoor fan (31) is a centrifugal blower which draws air from below and expels the air radially outward. The indoor fan (31) is arranged at the center in the casing body (21). The indoor fan (31) is driven by an indoor fan motor (31*a*). The indoor fan motor (31*a*) is fixed to a central portion of the top panel (21*a*).

<Bell Mouth>

The bell mouth (36) is arranged below the indoor fan (31). The bell mouth (36) is a member for guiding air that has flowed into the casing (20) to the indoor fan (31). The bell mouth (36) and the drain pan (33) divide the internal space of the casing (20) into a primary space (21*c*) located on a suction side of the indoor fan (31) and a secondary space (21*d*) located on an air-blowing side of the indoor fan (31).

<Indoor Heat Exchanger>

Figure 3:
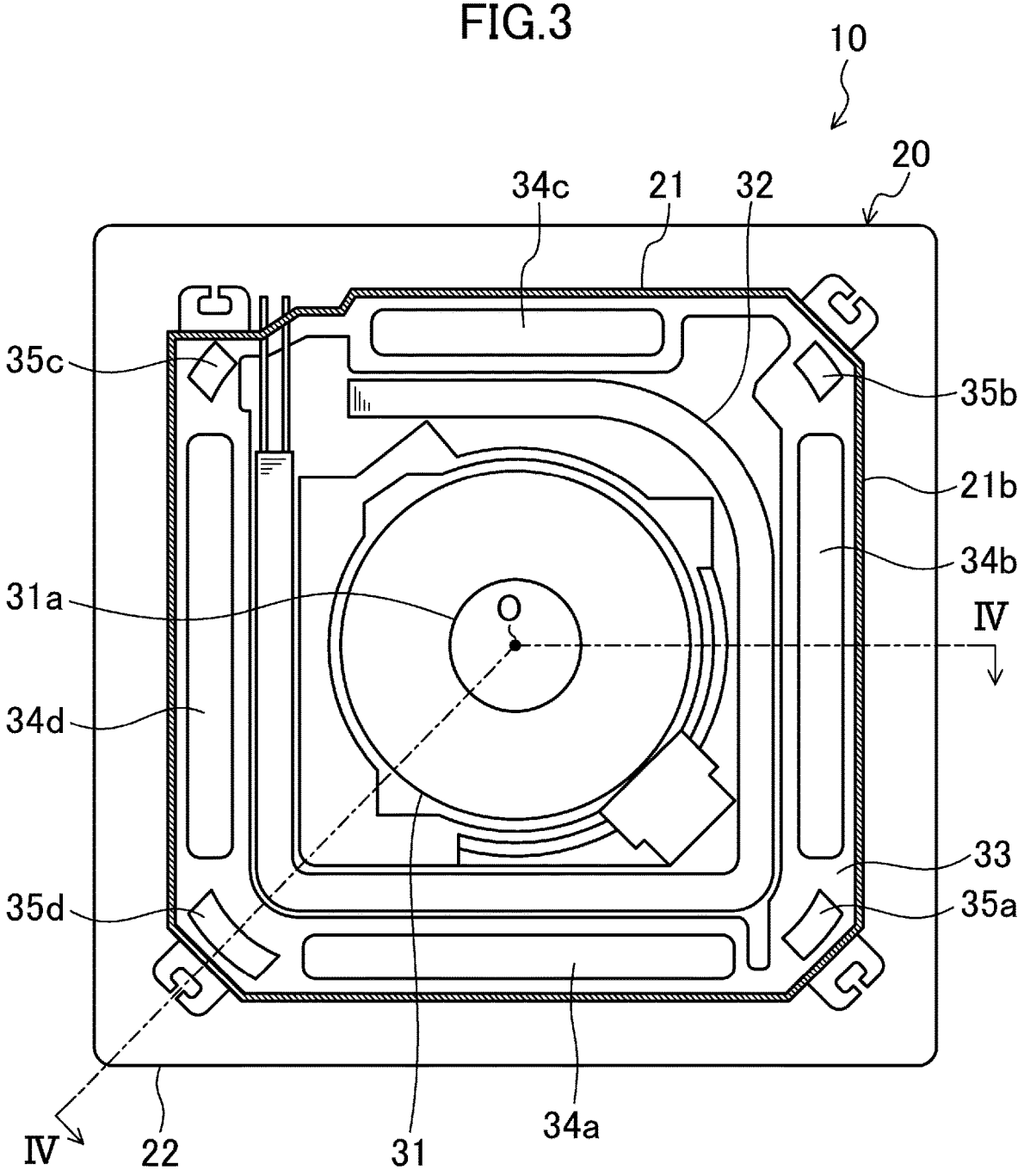
FIG. 3 is a diagram generally illustrating a plan view of the indoor unit from which a top panel of a casing body is omitted.

The indoor heat exchanger (32) is a so-called cross-fin-type fin-and-tube heat exchanger. As illustrated in FIG. 3, the indoor heat exchanger (32) is formed in a hollow rectangular shape in plan view, and is arranged to surround the indoor fan (31). That is, the indoor heat exchanger (32) is arranged in the secondary space (21*d*). The indoor heat exchanger (32) allows the air passing therethrough from the inside to the outside to exchange heat with the refrigerant in the refrigerant circuit.

<Drain Pan>

The drain pan (33) is a member made of so-called Styrofoam. As illustrated in FIG. 4, the drain pan (33) is arranged to block a lower end of the casing body (21). The drain pan (33) has an upper surface provided with a water receiving groove (33*b*) extending along a lower end of the indoor heat exchanger (32). A lower end portion of the indoor heat exchanger (32) is inserted in the water receiving groove (33*b*). The water receiving groove (33*b*) receives drain water generated in the indoor heat exchanger (32).

As illustrated in FIG. 3, the drain pan (33) is provided with four main outlet paths (34*a* to 34*d*) and four auxiliary outlet paths (35*a* to 35*d*). The main outlet paths (34*a* to 34*d*) and the auxiliary outlet paths (35*a* to 35*d*) are paths in which the air that has passed through the indoor heat exchanger (32) flows. The main outlet paths (34*a* to 34*d*) and the auxiliary outlet paths (35*a* to 35*d*) pass through the drain pan (33) in a vertical direction. The main outlet paths (34*a* to 34*d*) are through holes each having an elongated rectangular cross section. The main outlet paths (34*a* to 34*d*) are disposed along the four sides of the casing body (21). Each side of the casing body (21) is provided with one main outlet path. The auxiliary outlet paths (35*a* to 35*d*) are through holes each having a slightly curved rectangular cross section. The auxiliary outlet paths (35*a* to 35*d*) are disposed at the four corners of the casing body (21). Each corner of the casing body (21) is provided with one auxiliary outlet path. That is, the main outlet paths (34*a* to 34*d*) and the auxiliary outlet paths (35*a* to 35*d*) are alternately arranged along the peripheral edge of the drain pan (33).

<Decorative Panel>

The decorative panel (22) is a resin member formed into a thick rectangular plate-like shape. As illustrated in FIG. 2, the lower portion of the decorative panel (22) is in a square shape slightly larger than the top panel (21*a*) of the casing body (21). The decorative panel (22) is arranged to cover the lower end of the casing body (21). The lower surface of the decorative panel (22) serves as a lower surface of the casing (20) and is exposed to the indoor space (500).

Figure 5:
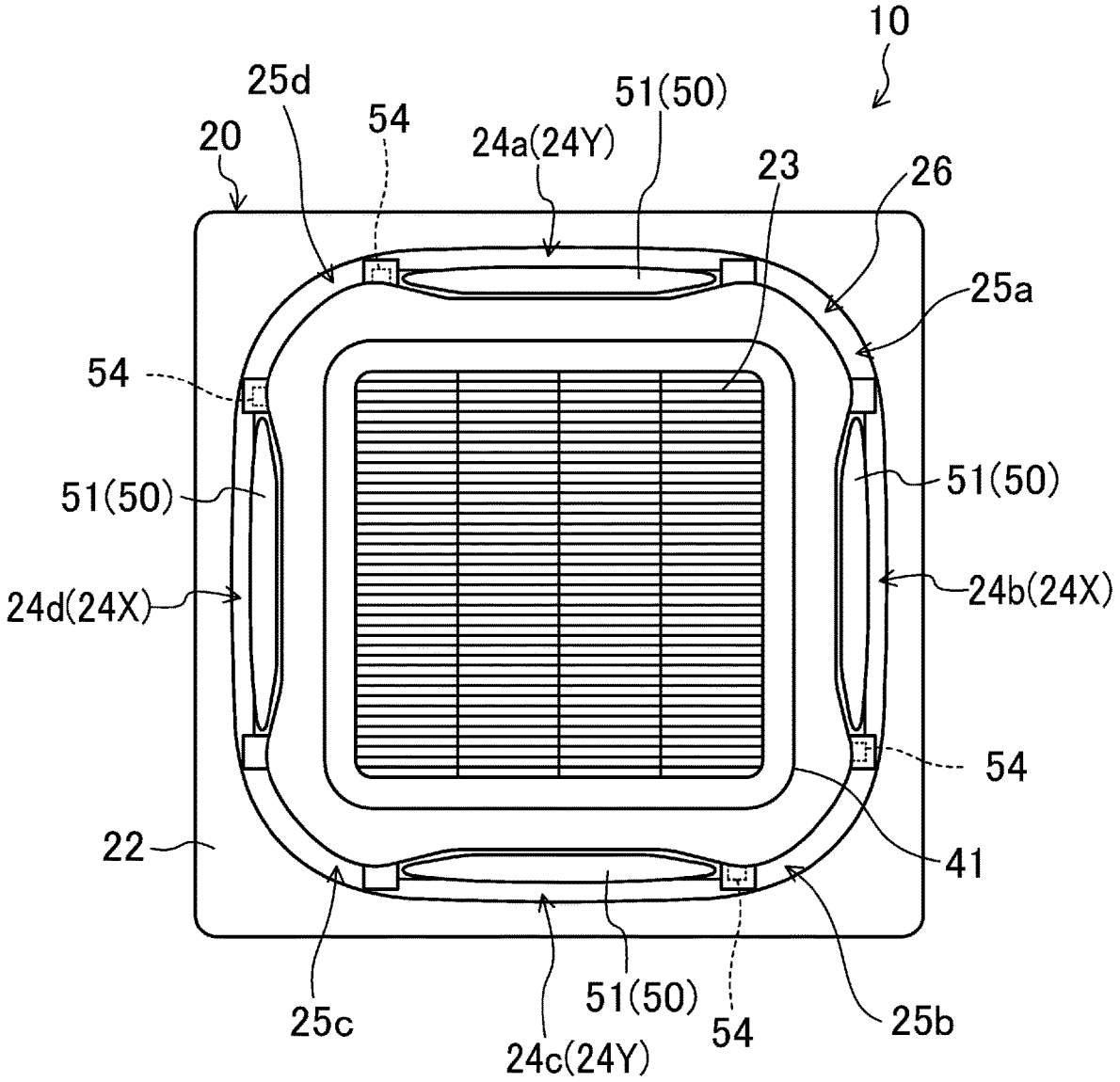
FIG. 5 is a diagram generally illustrating a bottom view of the indoor unit.

As illustrated in FIGS. 2, 4, and 5, a central portion of the decorative panel (22) has a single square inlet (23). The inlet (23) passes through the decorative panel (22) in the vertical direction and communicates with the primary space (21*c*) in the casing (20). The air drawn into the casing (20) flows into the primary space (21*c*) through the inlet (23). The inlet (23) is provided with a grid-like intake grille (41). An intake filter (42) is arranged above the intake grille (41).

The decorative panel (22) includes a substantially rectangular annular outlet (26) surrounding the inlet (23). As illustrated in FIG. 5, the outlet (26) is divided into four main outlet openings (24*a* to 24*d*) (which correspond to outlet openings) and four auxiliary outlet openings (25*a* to 25*d*).

Each of the main outlet openings (24*a* to 24*d*) has an elongated shape which corresponds to the cross sectional shape of each of the main outlet paths (34*a* to 34*d*). The main outlet openings (24*a* to 24*d*) are disposed along the four sides of the decorative panel (22). Each side of the decorative panel (22) is provided with one main outlet opening. In the indoor unit (10) of the present embodiment, the second main outlet opening (24*b*) and the fourth main outlet opening (24*d*) arranged along two sides, opposite to each other, of the decorative panel (22) constitute a first opening (24X). The first main outlet opening (24*a*) and the third main outlet opening (24*c*) constitute a second opening (24Y).

The main outlet openings (24*a* to 24*d*) of the decorative panel (22) correspond to the main outlet paths (34*a* to 34*d*) of the drain pan (33) on a one-on-one basis. Each of the main outlet openings (24*a* to 24*d*) communicates with a corresponding one of the main outlet paths (34*a* to 34*d*). That is, the first main outlet opening (24*a*) communicates with the first main outlet path (34*a*). The second main outlet opening (24*b*) communicates with the second main outlet path (34*b*). The third main outlet opening (24*c*) communicates with the third main outlet path (34*c*). The fourth main outlet opening (24*d*) communicates with the fourth main outlet path (34*d*).

Each of the auxiliary outlet openings (25*a* to 25*d*) is in the shape of a quarter of a circle. The auxiliary outlet openings (25*a* to 25*d*) are disposed at the four corners of the decorative panel (22). Each corner of the decorative panel (22) is provided with one auxiliary outlet opening. The auxiliary outlet openings (25*a* to 25*d*) of the decorative panel (22) correspond to the auxiliary outlet paths (35*a* to 35*d*) of the drain pan (33) on a one-on-one basis. Each of the auxiliary outlet openings (25*a* to 25*d*) communicates with a corresponding one of the auxiliary outlet paths (35*a* to 35*d*). That is, the first auxiliary outlet opening (25*a*) communicates with the first auxiliary outlet path (35*a*). The second auxiliary outlet opening (25*b*) communicates with the second auxiliary outlet path (35*b*). The third auxiliary outlet opening (25*c*) communicates with the third auxiliary outlet path (35*c*). The fourth auxiliary outlet opening (25*d*) communicates with the fourth auxiliary outlet path (35*d*).

<Airflow Direction Adjusting Flap>

As illustrated in FIG. 5, each of the main outlet openings (24*a* to 24*d*) is provided with an airflow direction adjusting flap (51). The airflow direction adjusting flap (51) is a member which adjusts the direction of supply airflow (that is, the direction of air coming from the main outlet openings (24*a* to 24*d*)).

The airflow direction adjusting flap (51) changes the direction of supply airflow upward and downward. That is, the airflow direction adjusting flap (51) changes the direction of supply airflow such that the angle between the direction of supply airflow and the horizontal direction changes.

The airflow direction adjusting flap (51) has an elongated plate-like shape extending from one longitudinal end to the other longitudinal end of the main outlet opening (24*a* to 24*d*) formed in the decorative panel (22). As illustrated in FIG. 4, the airflow direction adjusting flap (51) is supported by a support member (52) so as to be rotatable about a central shaft (53) of the airflow direction adjusting flap (51) extending in the longitudinal direction thereof. The airflow direction adjusting flap (51) is curved such that its lateral cross section (a cross section taken in a direction orthogonal to the longitudinal direction) forms a convex shape in a direction away from the central shaft (53) of swing movement.

As illustrated in FIG. 5, a drive motor (54) is coupled to each airflow direction adjusting flap (51). The airflow direction adjusting flap (51) is driven by the drive motor (54), and rotates about the central shaft (53) within a predetermined angle range. Although described in detail later, the airflow direction adjusting flap (51) can move to an airflow blocking position where the airflow direction adjusting flap (51) interrupts the flow of air passing through the main outlet opening (24*a* to 24*d*). The airflow direction adjusting flap (51) also functions as an airflow blocking mechanism (50) which blocks the supply airflow through the main outlet opening (24*a* to 24*d*).

<Various Sensors>

As illustrated in FIG. 4, the indoor unit (10) is further provided with an inlet temperature sensor (61) and a heat exchange temperature sensor (62).

The inlet temperature sensor (61) is disposed near the inlet of the bell mouth (36) in the primary space (21*c*). The inlet temperature sensor (61) senses a temperature of air flowing in the primary space (21*c*), that is, a temperature of air drawn into the casing body (21) from the indoor space (500) through the inlet (23).

The heat exchange temperature sensor (62) is disposed near the surface of the indoor heat exchanger (32). The heat exchange temperature sensor (62) senses a temperature of the surface of the indoor heat exchanger (32).

—General Description of Configuration and Control of Control Unit—

As illustrated in FIG. 6, the controller (70) is connected to the sensors (61, 62) included in each indoor units (10), the drive motor (54) of each airflow direction adjusting flap (51), the indoor fan motor (31*a*) of the indoor fan (31) or the like so as to be able to communicate with these components. Although not shown, the controller (70) is also connected to the compressor motor of the compressor included in the outdoor unit (80) so as to be able to communicate with the compressor motor. With the CPU reading and executing programs stored in the memory, the controller (70) controls the rotational speed of the indoor fan (31) and the rotational speed of the compressor motor. Further, the controller (70) is configured to be able to calculate an index indicating a load of the indoor space (500), using values measured by the sensors (61, 62).

The controller (70) actuates each drive motor (54) to control the positions of the airflow direction adjusting flaps (51) included in each of the indoor units (10) independently from one another, thereby controlling the airflow direction blown from each of the main outlet openings (24*a* to 24*d*). The controller (70) also controls the positions of the airflow direction adjusting flaps (51) of each of the indoor units (10) so that the respective indoor units (10) may perform a full supply operation or a partial supply operation. Further, the controller (70) controls the positions of the airflow direction adjusting flaps (51) provided at the respective main outlet openings (24*a* to 24*d*) so that the respective indoor units (10) may selectively perform a standard supply mode and an airflow rotation.

The indoor unit (10) for which the standard supply mode is selected performs only the full supply operation. That is, the indoor unit (10) for which the standard supply mode is selected performs the full supply operation all the time. The indoor unit (10) for which the airflow rotation is selected performs the partial supply operation and the full supply operation in an alternate manner, for example, and changes the main outlet openings (24*a* to 24*d*) through which air is supplied. Details about the control by the controller (70) will be described in "—Control Operation of Airflow Direction Adjusting Flap—" and "—Control While Adjacent Indoor Units Perform Partial Supply Operation—."

Note that the terms "heating operation" and the "cooling operation" used in the present embodiment include supplying conditioned air into the indoor space (500) by the operation of both of the compressor and the indoor fan (31), and also include a state in which the operation of the compressor is temporarily stopped while the operation of the indoor fan (31) continues (i.e., a circulation operation).

—Airflow in Indoor Unit—

The indoor fan (31) rotates during the operation of the indoor unit (10). The rotating indoor fan (31) allows the indoor air in the indoor space (500) to pass through the inlet (23) and flow in the primary space (21*c*) in the casing (20). The air which has flowed in the primary space (21*c*) is drawn by the indoor fan (31) and expelled into the secondary space (21*d*).

The air which has flowed into the secondary space (21*d*) is cooled or heated while passing through the indoor heat exchanger (32), and then flows separately into the four main outlet paths (34*a* to 34*d*) and four auxiliary outlet paths (35*a* to 35*d*). The air which has flowed into the main outlet paths (34*a* to 34*d*) is supplied to the indoor space (500) through the main outlet openings (24*a* to 24*d*). The air which has flowed into the auxiliary outlet paths (35*a* to 35*d*) is supplied to the indoor space (500) through the auxiliary outlet openings (25*a* to 25*d*).

That is, the indoor fan (31) generates the flow of air coming into the casing body (21) from the indoor space (500) through the inlet (23) and supplied back into the indoor space (500) through the outlet (26).

In the indoor unit (10) performing a cooling operation, the indoor heat exchanger (32) serves as an evaporator, so that the air before supplied into the indoor space (500) is cooled by the refrigerant while the air passes through the indoor heat exchanger (32). In the indoor unit (10) performing a heating operation, the indoor heat exchanger (32) serves as a condenser, so that the air before supplied into the indoor space (500) is heated by the refrigerant while the air passes through the indoor heat exchanger (32).

<Possible Positions of Airflow Direction Adjusting Flap>

Now, possible positions of each airflow direction adjusting flap (51) will be described.

As mentioned above, the airflow direction adjusting flap (51) changes the direction of supply airflow by rotating about the central shaft (53). The airflow direction adjusting flap (51) is movable between a horizontal airflow position illustrated in FIG. 7 and a downward airflow position illustrated in FIG. 8. The airflow direction adjusting flap (51) may further rotate from the downward airflow position illustrated in FIG. 8 and move to an airflow blocking position illustrated in FIG. 9.

Figure 7:
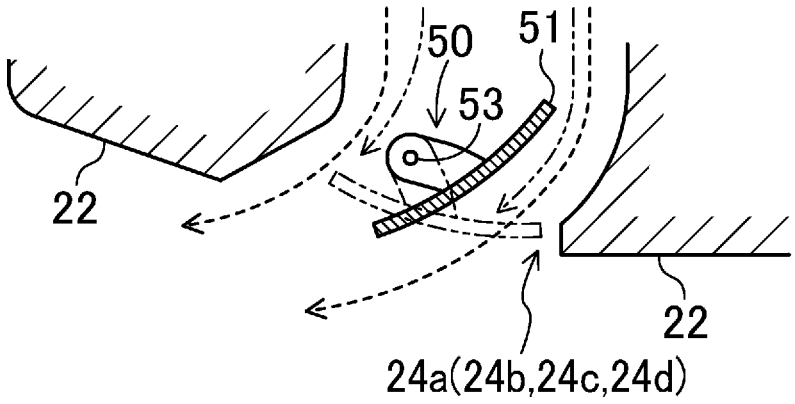
FIG. 7 is a diagram illustrating a cross-sectional view of a main part of a decorative panel, showing an airflow direction adjusting flap in a horizontal airflow position.

When the airflow direction adjusting flap (51) is in the horizontal airflow position illustrated in FIG. 7, the downward direction of the air coming from the main outlet path (34*a* to 34*d*) is changed to a lateral direction, and the supply airflow coming from the main outlet opening (24*a* to 24*d*) is in the horizontal supply state. In this case, the direction of supply airflow through the main outlet opening (24*a* to 24*d*) (that is, the direction of air coming from the main outlet opening (24*a* to 24*d*)) is set to be, for example, about 25° from the horizontal direction. That is, strictly saying, the direction of the supply airflow is angled slightly downward from the horizontal direction, but substantially the same as the horizontal direction. The horizontal supply state of the airflow allows the air coming from the main outlet opening (24*a* to 24*d*) to reach the wall of the indoor space (500).

The horizontal supply state is not limited to an airflow about 25° downward with respect to the horizontal direction, and may also include an airflow about 25° upward, that is, slightly upward, with respect to the horizontal direction. Further, the horizontal supply state can be appropriately set through the control using a remote controller or the like. For example, the airflow angle during the horizontal supply state may be set to an appropriate angle according to a purpose of operating the indoor unit (10), for example, according to a mode for preventing ceiling contamination. The horizontal supply state may include an airflow about 10°, about 15°, or about 30° downward with respect to the horizontal direction, because the horizontal supply state refers to a state in which air is supplied to the indoor space (500) approximately horizontally from the main outlet openings (24*a* to 24*d*).

Figure 8:
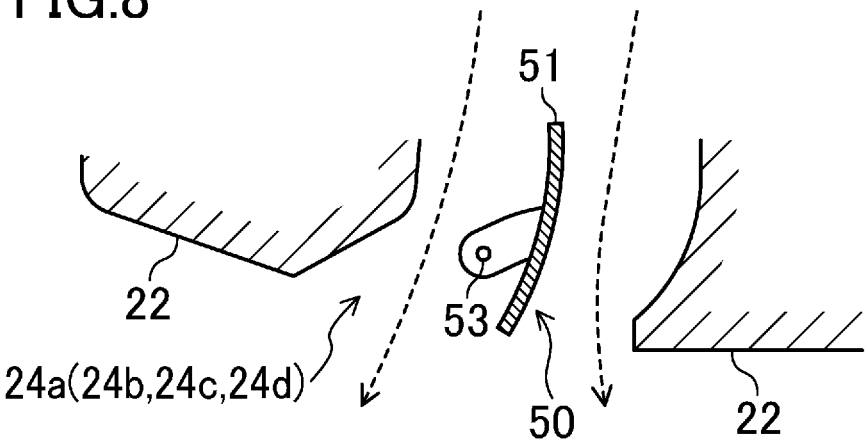
FIG. 8 is a diagram illustrating a cross-sectional view of the main part of the decorative panel, showing the airflow direction adjusting flap in a downward airflow position.

When the airflow direction adjusting flap (51) is in the downward airflow position illustrated in FIG. 8, the downward direction of the air coming from the main outlet path (34*a* to 34*d*) is maintained substantially as it is, and the supply airflow coming from the main outlet opening (24*a* to 24*d*) is directed downward. In this case, strictly saying, the direction of the supply airflow is slightly angled from the vertical direction, that is, obliquely downward, away from the inlet (23).

Figure 9:
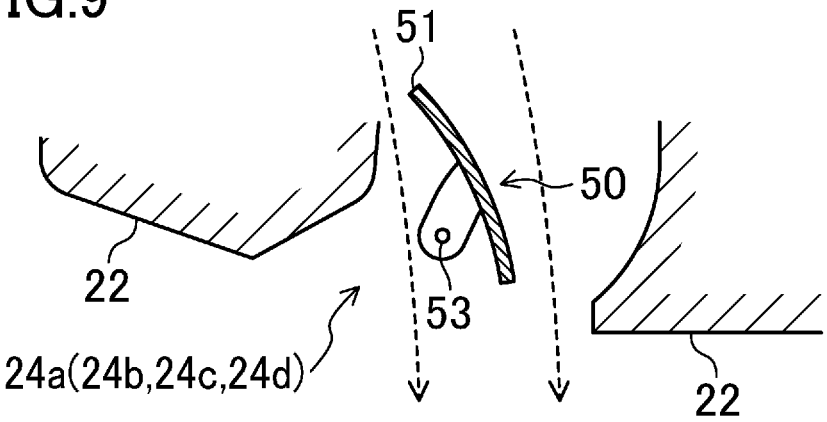
FIG. 9 is a diagram illustrating a cross-sectional view of the main part of the decorative panel, showing the airflow direction adjusting flap in an airflow blocking position.

When the airflow direction adjusting flap (51) is in an airflow blocking position illustrated in FIG. 9, a large portion of the main outlet opening (24*a* to 24*d*) is closed by the airflow direction adjusting flap (51), and the downward direction of the air coming from the main outlet path (34*a* to 34*d*) is changed toward the inlet (23). In this case, the pressure loss of the air passing through the main outlet opening (24*a* to 24*d*) increases, and the total value of the flow rates of air (i.e., the volume of air) passing through all of the main outlet openings (24*a* to 24*d*) decreases. However, when the positions of only some of the airflow direction adjusting flaps (51) of any one of the indoor units (10) are changed from the state where all of the airflow direction adjusting flaps (51) take the positions illustrated in FIG. 7 or 8 to the airflow blocking positions, the flow rate of air (i.e., the volume of air) passing through each of the main outlet openings (24*a* to 24*d*) corresponding to the rest of the airflow direction adjusting flaps (51) taking the positions illustrated in FIG. 7 or 8 are increased, compared to the flow rate prior to the changes of the positions. That is, when the positions of some of all the airflow direction adjusting flaps (51) are changed from the positions illustrated in FIG. 7 or 8 to the airflow blocking positions (FIG. 9), the overall amount of air supplied from one indoor unit (10) is reduced, but the volume of air supplied through the main outlet openings (24*a* to 24*d*) corresponding to the airflow direction adjusting flaps (51) still taking the positions illustrated in FIG. 7 or 8 increases after the change of the positions.

In the airflow blocking position, the air is supplied toward the inlet (23) from the main outlet opening (24*a* to 24*d*). Thus, the air coming from the main outlet opening (24*a* to 24*d*) is immediately sucked in the inlet (23). That is, substantially no air is supplied to the indoor space (500) through the main outlet opening (24*a* to 24*d*) where the airflow direction adjusting flap (51) is taking the airflow blocking position.

—Control Operation of Airflow Direction Adjusting Flap—

<Airflow Rotation>

During the airflow rotation, the controller (70) keeps the rotational speed of the indoor fan (31) substantially at the maximum value. The airflow rotation will be described in detail below. For ease of explanation, one indoor unit (10) is taken as an example.

The airflow rotation according to the present embodiment includes three modes, namely, a first supply mode, a second supply mode, and a third supply mode. In which mode the airflow rotation is performed is preferably set by an installation operator or a maintenance operator of the indoor unit (10) by means of a remote controller or a dip switch (not shown).

(First Supply Mode)

Figure 10:
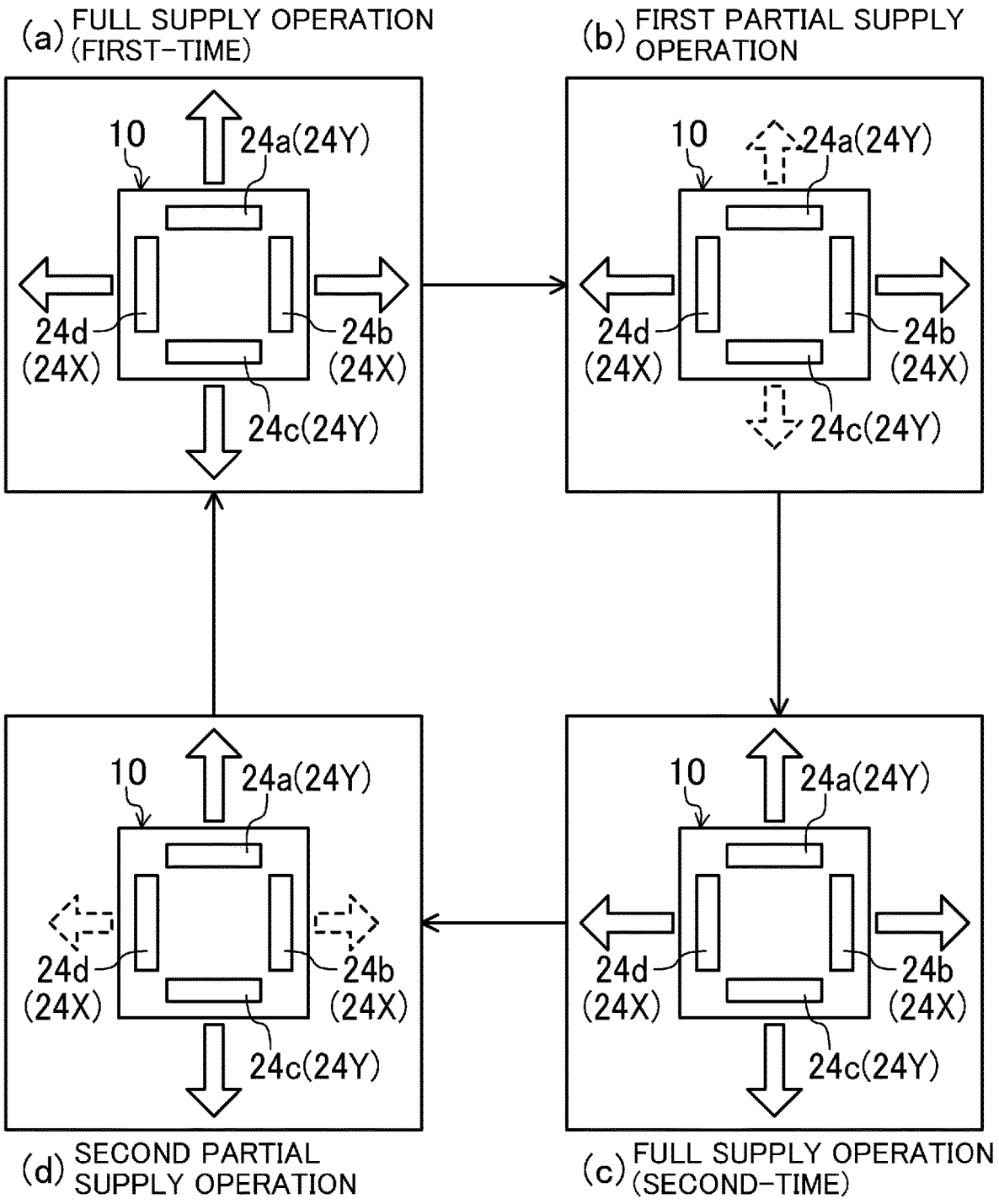
FIG. 10 is a diagram for explaining one cycle of a first supply mode, schematically showing a lower surface of the indoor unit in each operation.

As illustrated in FIG. 10, the full supply operation and the partial supply operation are alternately performed in one cycle of the first supply mode. The partial supply operation of FIG. 10 includes two different combinations of the main outlet openings (24*a* to 24*d*), of one indoor unit (10), through which air is blown (specifically, a first partial supply operation and a second partial supply operation). In the first supply mode of FIG. 10, a first-time full supply operation, the first partial supply operation, a second-time full supply operation, and the second partial supply operation are sequentially performed in the stated order.

<First Supply Mode in Heating Operation>

In the full supply operation during the heating operation, the controller (70) sets the airflow direction adjusting flaps (51) of all the main outlet openings (24*a* to 24*d*) to the downward airflow positions. In this setting, warm air is blown downward and is supplied to the indoor space (500) from the four main outlet openings (24*a* to 24*d*).

In the first partial supply operation during the heating operation, the controller (70) sets the airflow direction adjusting flaps (51) of the two main outlet openings (24*b*, 24*d*) constituting the first opening (24X) to the horizontal airflow position, and the airflow direction adjusting flaps (51) of the main outlet openings (24*a*, 24*c*) constituting the second opening (24Y) to the airflow blocking position. In this setting, air is blown substantially in the horizontal direction from the first opening (24X) at a higher speed than in the full supply operation, and substantially no air is blown from the second opening (24Y).

In the second partial supply operation during the heating operation, the controller (70) sets the airflow direction adjusting flaps (51) of the second opening (24Y) to the horizontal airflow position, and the airflow direction adjusting flaps (51) of first opening (24X) to the airflow blocking position. In this setting, air is blown substantially in the horizontal direction from the second opening (24Y) at a higher speed than in the full supply operation, and substantially no air is blown from the first opening (24X).

During the first supply mode in the heating operation, air is blown from the auxiliary outlet openings (25*a* to 25*d*) all the time.

Further, the duration of each of the full supply operation, the first partial supply operation, and the second partial supply operation may be the same (e.g., 120 seconds) or may different from one another.

<First Supply Mode in Cooling Operation>

In the full supply operation during the cooling operation, the controller (70) makes the airflow direction adjusting flaps (51) of all the main outlet openings (24*a* to 24*d*) move between the horizontal airflow position and the downward airflow position. In this operation, cool air is supplied into the indoor space (500) from the four main outlet openings (24*a* to 24*d*), and the direction of the supply airflow changes. Note that, in the full supply operation during the cooling operation, the lower limit of the moving range of the airflow direction adjusting flap (51) may be set to a position higher than the downward airflow position (i.e., a position closer to the horizontal airflow position).

The first partial supply operation during the cooling operation is similar to the above-described first partial supply operation during the heating operation, except that the temperature of air to be supplied is different. The second partial supply operation during the cooling operation is similar to the above-described second partial supply operation during the heating operation.

During the first supply mode in the cooling operation, air is blown from the auxiliary outlet openings (25*a* to 25*d*) all the time.

Further, the duration of each of the full supply operation, the first partial supply operation, and the second partial supply operation may be the same. Further, it is preferable that the duration of each of the first- and second-time full supply operations be set to be longer than the duration of each of the first and second partial supply operations. For example, the duration of each of the first- and second-time full supply operations is set to be 600 seconds, and the duration of each of the first and second partial supply operations is set to be 120 seconds.

<Second Supply Mode>

Figure 11:
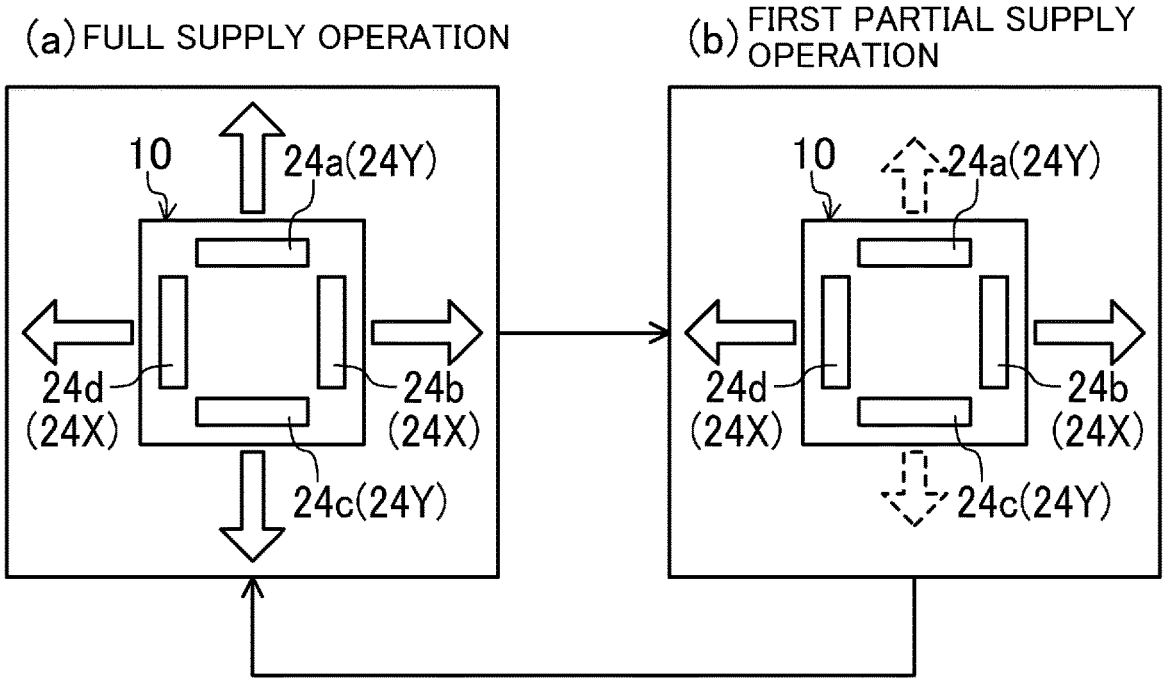
FIG. 11 is a diagram for explaining one cycle of a second supply mode, schematically showing a lower surface of the indoor unit in each operation.

As illustrated in FIG. 11, in one cycle of the second supply mode, one full supply operation and one first partial supply operation as the partial supply operation are alternately performed.

<Second Supply Mode in Heating Operation>

In the full supply operation during the heating operation, the controller (70) sets the airflow direction adjusting flaps (51) of all the main outlet openings (24*a* to 24*d*) to the downward airflow positions. That is, the full supply operation in the second supply mode during the heating operation is similar to the full supply operation in the first supply mode during the heating operation.

In the first partial supply operation during the heating operation, the controller (70) sets the airflow direction adjusting flaps (51) of the first opening (24X) to the horizontal airflow position, and the airflow direction adjusting flaps (51) of the second opening (24Y) to the airflow blocking position. That is, the first supply operation in the second supply mode during the heating operation is similar to the first supply operation in the first supply mode during the heating operation.

Similarly to the first supply mode during the heating operation, the duration of each of the full supply operation and the first partial supply operation may be or may not be the same as each other.

<Second Supply Mode in Cooling Operation>

In the full supply operation during the cooling operation, the controller (70) makes the airflow direction adjusting flaps (51) of all the main outlet openings (24*a* to 24*d*) move between the horizontal airflow position and the downward airflow position. That is, the full supply operation in the second supply mode during the cooling operation is similar to the full supply operation in the first supply mode during the cooling operation.

In the first partial supply operation during the cooling operation, the controller (70) sets the airflow direction adjusting flaps (51) of the first opening (24X) to the horizontal airflow position, and the airflow direction adjusting flaps (51) of the second opening (24Y) to the airflow blocking position. That is, the first partial supply operation in the second supply mode during the cooling operation is similar to the first partial supply operation in the first supply mode during the heating operation.

Similarly to the first supply mode during the cooling operation, the duration of each of the full supply operation and the first partial supply operation may be the same as each other, or the duration of the full supply operation may be set to be longer than the duration of the first partial supply operation.

<Third Supply Mode>

Figure 12:
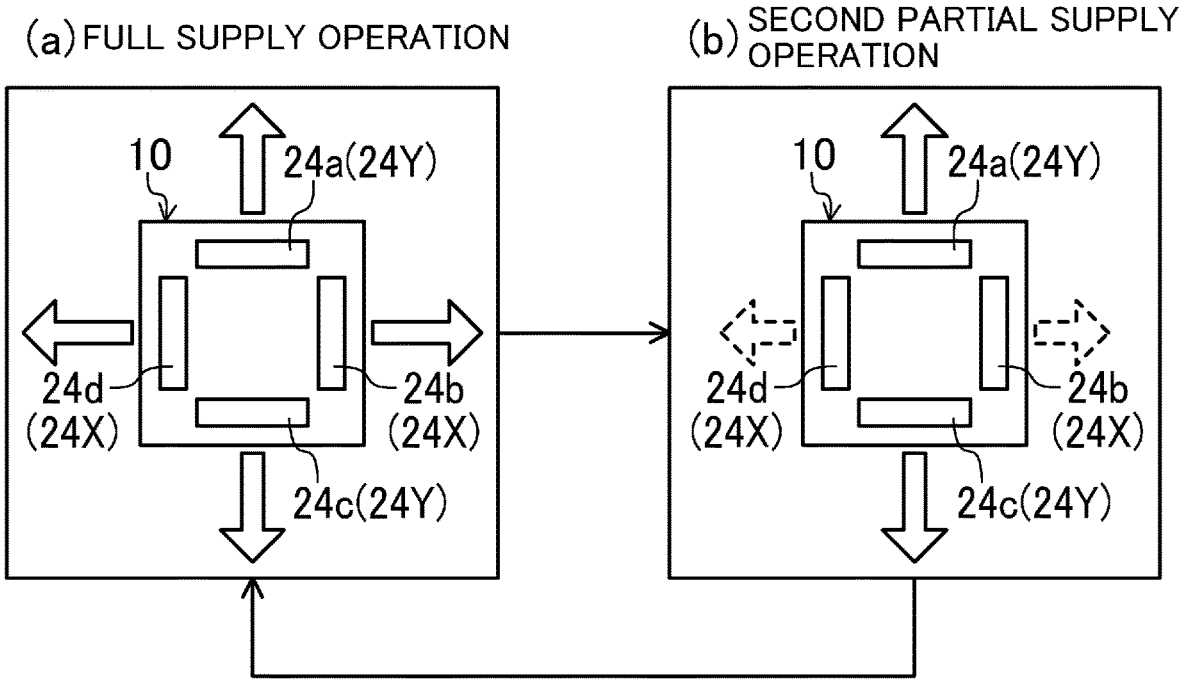
FIG. 12 is a diagram for explaining one cycle of a third supply mode, schematically showing a lower surface of the indoor unit in each operation.

As illustrated in FIG. 12, in one cycle of the third supply mode, one full supply operation and one second partial supply operation as the partial supply operation are alternately performed.

<Third Supply Mode in Heating Operation>

In the full supply operation during the heating operation, the controller (70) sets the airflow direction adjusting flaps (51) of all the main outlet openings (24*a* to 24*d*) to the downward airflow positions. That is, the full supply operation in the third supply mode during the heating operation is similar to the full supply operation in the first supply mode during the heating operation.

In the second partial supply operation during the heating operation, the controller (70) sets the airflow direction adjusting flaps (51) of the second opening (24Y) to the horizontal airflow position, and the airflow direction adjusting flaps (51) of first opening (24X) to the airflow blocking position. That is, the second partial supply operation in the third supply mode during the heating operation is similar to the second partial supply operation in the first supply mode during the heating operation.

Similarly to the first supply mode during the heating operation, the duration of each of the full supply operation and the second partial supply operation may or may not be the same as each other.

<Third Supply Mode in Cooling Operation>

In the full supply operation during the cooling operation, the controller (70) makes the airflow direction adjusting flaps (51) of all the main outlet openings (24*a* to 24*d*) move between the horizontal airflow position and the downward airflow position. That is, the full supply operation in the third supply mode during the cooling operation is similar to the full supply operation in the first supply mode during the heating operation.

In the second partial supply operation during the cooling operation, the controller (70) sets the airflow direction adjusting flaps (51) of the second opening (24Y) to the horizontal airflow position, and the airflow direction adjusting flaps (51) of the first opening (24X) to the airflow blocking position. That is, the first partial supply operation in the third supply mode during the cooling operation is similar to the first partial supply operation in the first supply mode during the heating operation.

Similarly to the first supply mode during the cooling operation, the duration of each of the full supply operation and the second partial supply operation may be the same as each other, or the duration of the full supply operation may be set to be longer than the duration of the second partial supply operation.

As described above, the partial supply operation includes two patterns, namely, the first partial supply operation and the second partial supply operation. Both of these operations can be said to be the operations in which air currents supplied from one or some of the main outlet openings (24*a* to 24*d*) are blocked by the airflow direction adjusting flaps (51) serving as the airflow blocking mechanism (50), thereby increasing the speed of air currents supplied from the rest of the main outlet openings (24*a* to 24*d*).

—Control While Adjacent Indoor Units Perform Partial Supply Operation—

A state in which adjacent indoor units (10) perform the partial supply operations, which can be said to be a characteristic of the present embodiment, will be described with reference to FIGS. 13 to 15.

Figure 13:
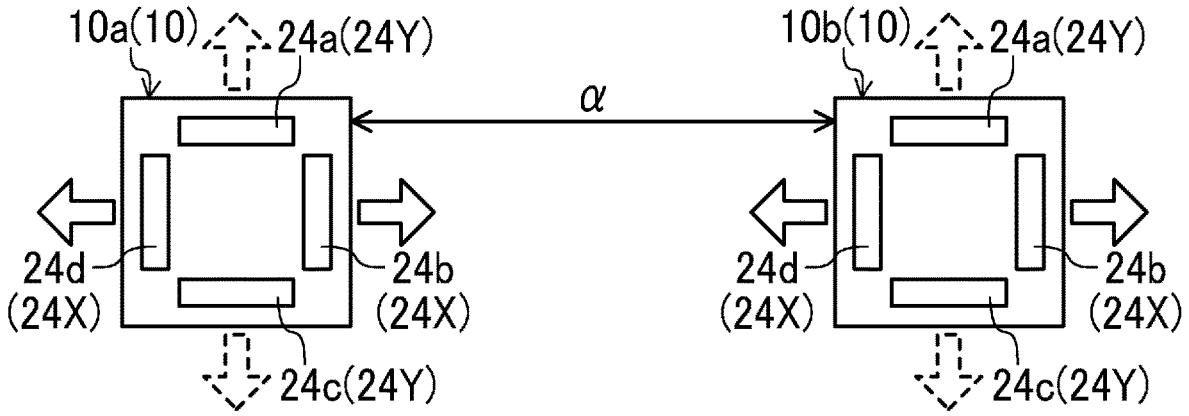
FIG. 13 is a diagram schematically illustrating lower surfaces of indoor units adjacent to each other, both of which are performing a first partial supply operation.
Figure 14:
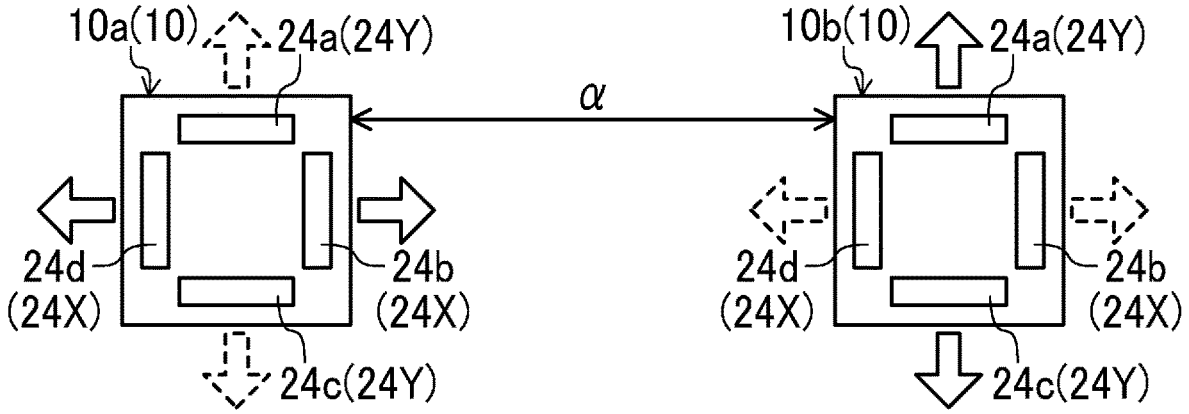
FIG. 14 is a diagram schematically illustrating lower surfaces of indoor units adjacent to each other, one of which is performing the first partial supply operation, and the other performing a second partial supply operation.
Figure 15:
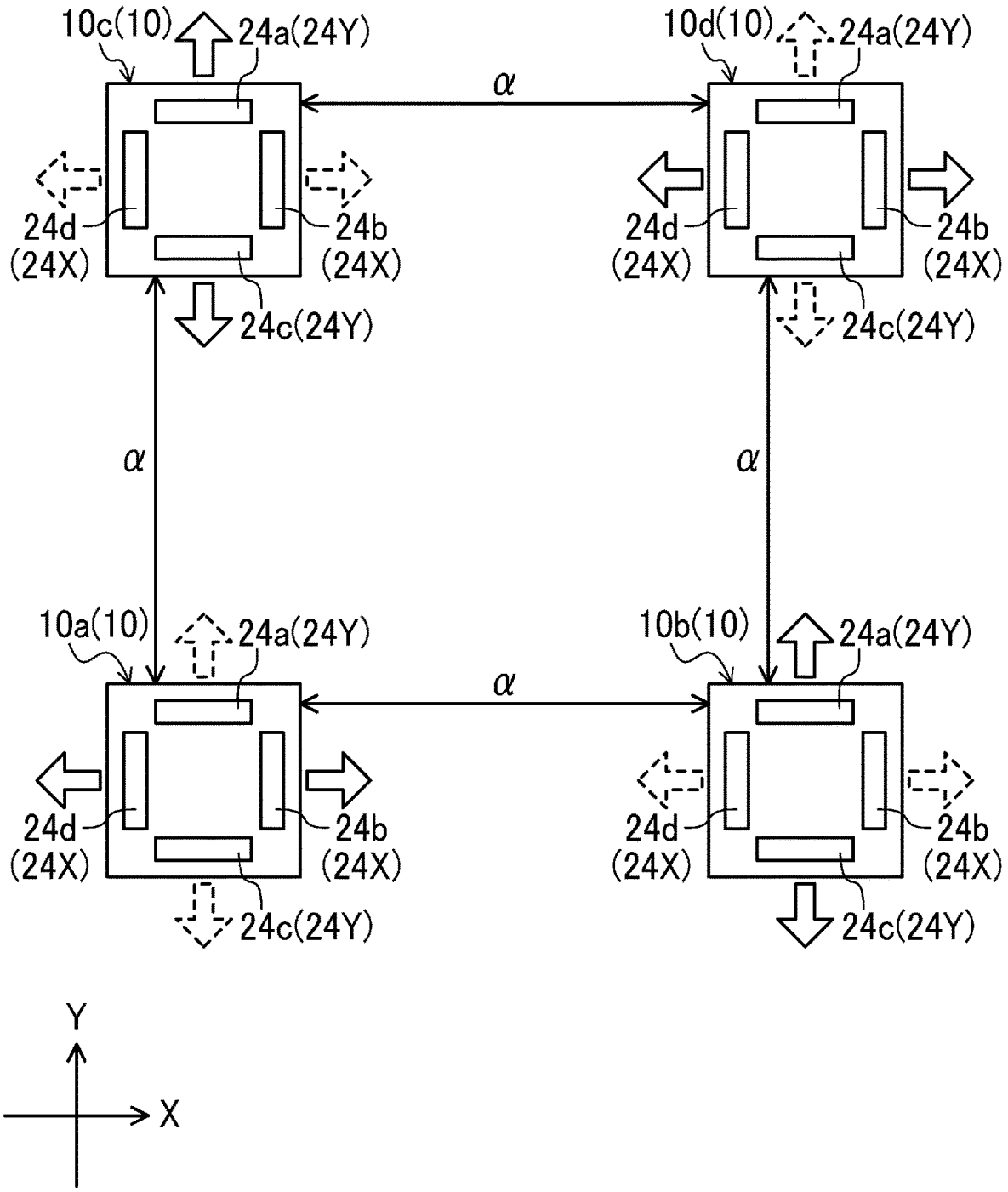
FIG. 15 is a diagram schematically illustrating lower surfaces of indoor units greater in number than in the case shown in FIG. 14, in which no air current is blown from one of two main outlet openings which face each other with a predetermined distance interposed therebetween.

For ease of explanation, FIGS. 13 to 15 show only two indoor units (10) adjacent to each other with a predetermined distance α interposed therebetween. In FIGS. 13 to 15, the two indoor units (10) are designated by different reference signs "10*a*" and "10*b*" to differentiate between the two indoor units (10).

Suppose that the indoor units (10*a*, 10*b*) perform the same operation at the same timing in the airflow rotation. FIG. 13 illustrates a state in which the indoor units (10*a*, 10*b*) simultaneously perform the first partial supply operation. In this case, regardless of whether in the heating operation or in the cooling operation, the air current is blown in the horizontal direction and toward the indoor unit (10*b*) from the main outlet opening (24*b*) of the indoor unit (10*a*), and the air current is blown in the horizontal direction and toward the indoor unit (10*a*) from the main outlet opening (24*d*), of the indoor unit (10*b*), which faces the main outlet opening (24*b*) with a predetermined distance α interposed therebetween. The air current blown from the main outlet opening (24*b*) of the indoor unit (10*a*) and the air current blown from the main outlet opening (24*d*) of the indoor unit (10*b*) collide with each other in a space between these indoor units (10*a*, 10*b*). The air currents which collide with each other are forced to flow downward, and may be blown directly on a user under the indoor units (10*a*, 10*b*). The user may feel uncomfortable due to the air currents blown directly onto the user.

To avoid this, the controller (70) of the present embodiment makes the airflow direction adjusting flap (51) function as the airflow blocking mechanism (50) so that no air current is blown from one of the main outlet opening (24*b*) of the indoor unit (10*a*) or the main outlet openings (24*d*) of the indoor unit (10*b*), the main outlet openings facing each other with the predetermined distance α interposed therebetween, while both of the indoor units (10*a*, 10*b*) adjacent to each other are performing the partial supply operation.

FIG. 14 illustrates an example of the above operation. In the example illustrated in FIG. 14, the indoor units (10*a*) and (10*b*) simultaneously perform the first and second partial supply operations, respectively. In the indoor unit (10*a*), the airflow direction adjusting flaps (51) provided at the main outlet openings (24*b*, 24*d*) are in a position other than the airflow blocking position. Thus, air currents are blown from the main outlet openings (24*b*, 24*d*). On the other hand, the airflow direction adjusting flaps (51) provided at the main outlet openings (24*a*, 24*c*) are in the airflow blocking position. Thus, no air current is blown from the main outlet openings (24*a*, 24*c*). In the indoor unit (10*b*), the airflow direction adjusting flaps (51) provided at the main outlet openings (24*a*, 24*c*) are in a position other than the airflow blocking position. Thus, air currents are blown from the main outlet openings (24*a*, 24*c*). On the other hand, the airflow direction adjusting flaps (51) provided at the main outlet openings (24*b*, 24*d*) are in the airflow blocking position. Thus, no air current is blown from the main outlet openings (24*b*, 24*d*). Looking at the main outlet opening (24*b*) of the indoor unit (10*a*) and the main outlet opening (24*d*) of the indoor unit (10*b*) which face each other with the predetermined distance α interposed therebetween, no air current is blown from one of the main outlet openings, which is the main outlet opening (24*d*) of the indoor unit (10*b*), and the air current is blown in the horizontal direction from the other main outlet opening, which is the main outlet opening (24*b*) of the indoor unit (10*a*).

Looking at the main outlet opening (24*d*) of the indoor unit (10*b*) and the main outlet opening (24*b*) of the indoor unit (10*a*) which face each other with the predetermined distance α interposed therebetween, air currents are not simultaneously blown from the main outlet openings (24*a*, 24*b*), and the collision of the air currents does not occur. Thus, the air currents are less likely to be blown directly on a user under the indoor units (10*a*, 10*b*), and the user is less likely to feel a draft.

FIG. 15 illustrates an example in which the control according to the present embodiment described with reference to FIG. 14 is applied to a case using more indoor units (10). FIG. 15 illustrates four indoor units (10), which are designated by different reference signs "10*a*," "10*b*," "10*c*," and "10*d*" to differentiate between the four indoor units (10).

The indoor units (10*a*) and (10*b*) are arranged in the X direction of FIG. 15, and so are the indoor units (10*c*) and (10*d*). The indoor units (10*a*) and (10*b*) are spaced from each other by a predetermined distance α, and so are the indoor units (10*c*) and (10*d*). The indoor units (10*a*) and (10*c*) are arranged in the Y direction of FIG. 15, and so are the indoor units (10*b*) and (10*d*). The indoor units (10*a*) and (10*c*) are spaced from each other by the predetermined distance α, and so are the indoor units (10*b*) and (10*d*). The indoor units (10*a*, 10*d*) arranged on a diagonal line simultaneously perform the first partial supply operation. The indoor units (10*b*, 10*c*) arranged on another diagonal line simultaneously perform the second partial supply operation.

The airflow direction adjusting flap (51) of one of the main outlet opening (24*a*) of the indoor unit (10*a*) or the main outlet opening (24*c*) of the indoor unit (10*c*), which face each other with the predetermined distance α interposed therebetween, is taking the airflow blocking position. The airflow direction adjusting flap (51) of one of the main outlet opening (24*b*) of the indoor unit (10*c*) or the main outlet opening (24*d*) of the indoor unit (10*d*), which face each other with the predetermined distance α interposed therebetween, is taking the airflow blocking position. The airflow direction adjusting flap (51) of one of the main outlet opening (24*c*) of the indoor unit (10*d*) or the main outlet opening (24*a*) of the indoor unit (10*b*), which face each other with the predetermined distance α interposed therebetween, is taking the airflow blocking position. The airflow direction adjusting flap (51) of one of the main outlet opening (24*d*) of the indoor unit (10*b*) or the main outlet opening (24*b*) of the indoor unit (10*a*), which face each other with the predetermined distance α interposed therebetween, is taking the airflow blocking position. Thus, no collision of air currents occurs among the four indoor units (10*a*, 10*b*, 10*e*, and 10*d*).

Advantages of Embodiment

In the present embodiment, as illustrated in FIGS. 14 and 15, no air current is blown into the indoor space (500) from one of the main outlet openings (24*a* to 24*d*), of the adjacent indoor units (10), which face each other with the predetermined distance α interposed therebetween in the partial supply operation, and an air current is blown from the other main outlet opening in the partial supply operation. In this configuration, air currents are not blown from the main outlet openings (24*a* to 24*d*) which face each other with the predetermined distance α interposed therebetween, and therefore not forced to flow downward as a result of collision of the air currents. This configuration therefore reduces the possibility that the air currents forced to flow downward is blown directly on a user under the indoor units (10). It is therefore possible to reduce a draft perceived by the user.

Further, in the present embodiment, the airflow rotation is carried out in which the full supply operation and the partial supply operation are alternately performed, as illustrated in FIGS. 10 to 12. During the partial supply operation of the airflow rotation, no air current is blown from one of the main outlet openings (24*a* to 24*d*) which face each other with the predetermined distance α interposed therebetween, and the air current is blown from the other outlet opening. In this configuration, air currents are not blown from the main outlet openings (24*a* to 24*d*) which face each other with the predetermined distance α interposed therebetween. Thus, the air currents do not merge with each other, which reduces the possibility that the air currents are blown directly on a user under the indoor units (10). Further, the airflow rotation allows the conditioned air to be supplied to an area in the indoor space (500) which is relatively close to the indoor unit (10) and an area in the indoor space (500) which is relatively far from the indoor unit (10), and thus to reduce a difference in the temperature among areas in the indoor space (500).

In the present embodiment, the airflow direction adjusting flap (51) for changing the direction of the supply airflow in the vertical direction also serves as an airflow blocking mechanism (50) for blocking the flow of air. That is, the airflow direction adjusting flap (51) taking a predetermined position blocks the air coming from the main outlet openings (24*a* to 24*d*).

Further, in the present embodiment, the casing (20) of each of the indoor units (10) has a rectangular lower surface (22), and the main outlet openings (24*a* to 24*d*) are arranged along the respective four sides of the outlet opening (22).

First Variation of Embodiment

Figure 16:
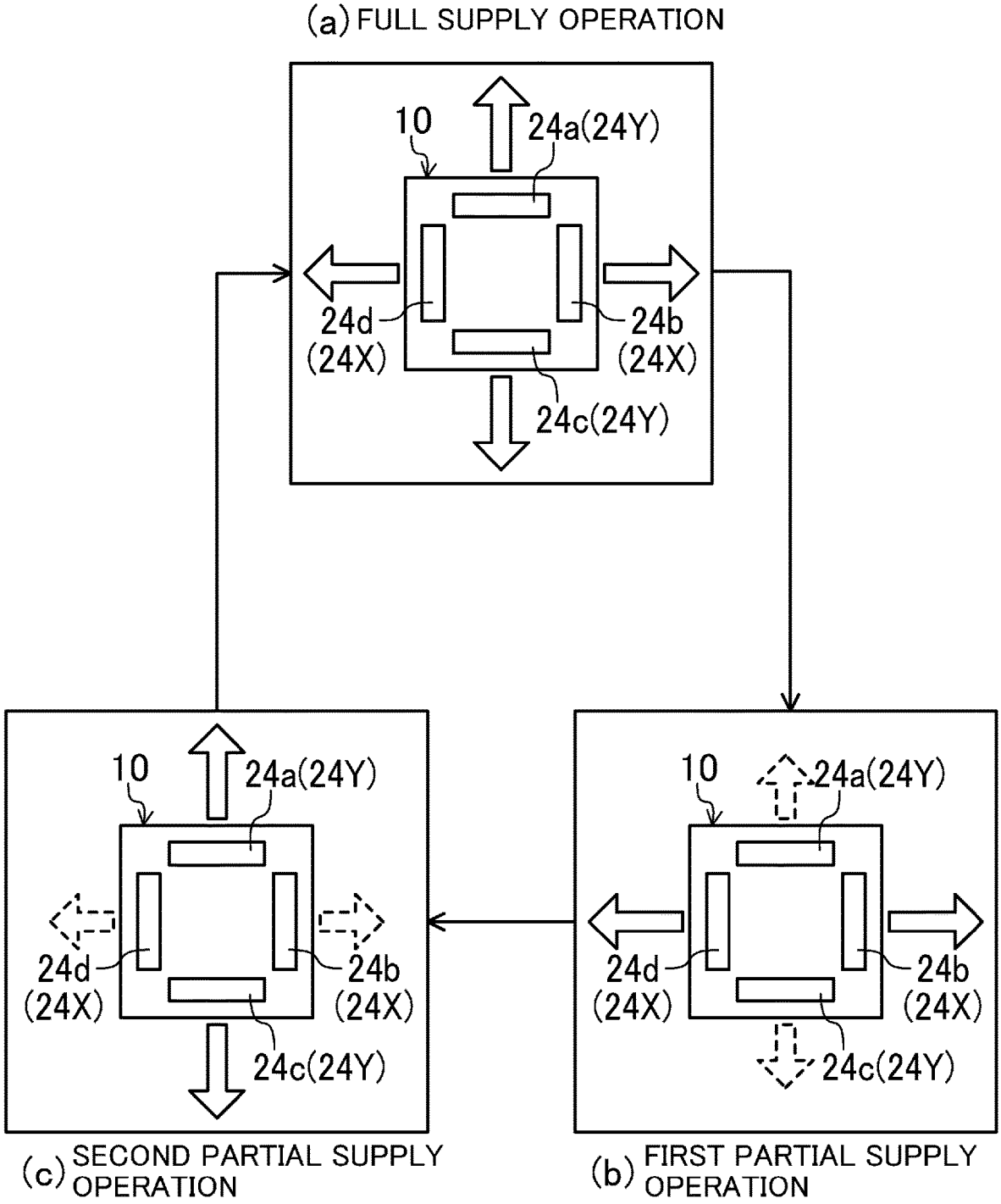
FIG. 16 is a diagram for explaining one cycle of a fourth supply mode according to a first variation, schematically showing a lower surface of the indoor unit in each operation.

Each of the indoor units (10) may be configured to be able to perform, as the airflow rotation, a fourth supply mode illustrated in FIG. 16 instead of the first supply mode, or in addition to the first to third supply modes. In the fourth supply mode, the full supply operation, the first partial supply operation, and the second partial supply operation are repeatedly performed in the stated order. In the fourth supply mode, too, the air current is stopped blowing from one of the main outlet openings (24*a* to 24*d*) facing each other with a predetermined distance α interposed therebetween during the first and second partial supply operations.

Second Variation of Embodiment

Each of the indoor units (10) may supply air into the indoor space (500) from adjacent main outlet openings (24*a* to 24*d*) during the first and second partial supply operations. Specifically, the main outlet openings (24*a*, 24*b*) may constitute a first opening (24X), and the main outlet openings (24*c*, 24*d*) may constitute a second opening (24Y). The air current is stopped blowing from one of the main outlet openings (24*a* to 24*d*) facing each other with a predetermined distance α interposed therebetween during the first and second partial supply operations.

Third Variation of Embodiment

Figure 17:
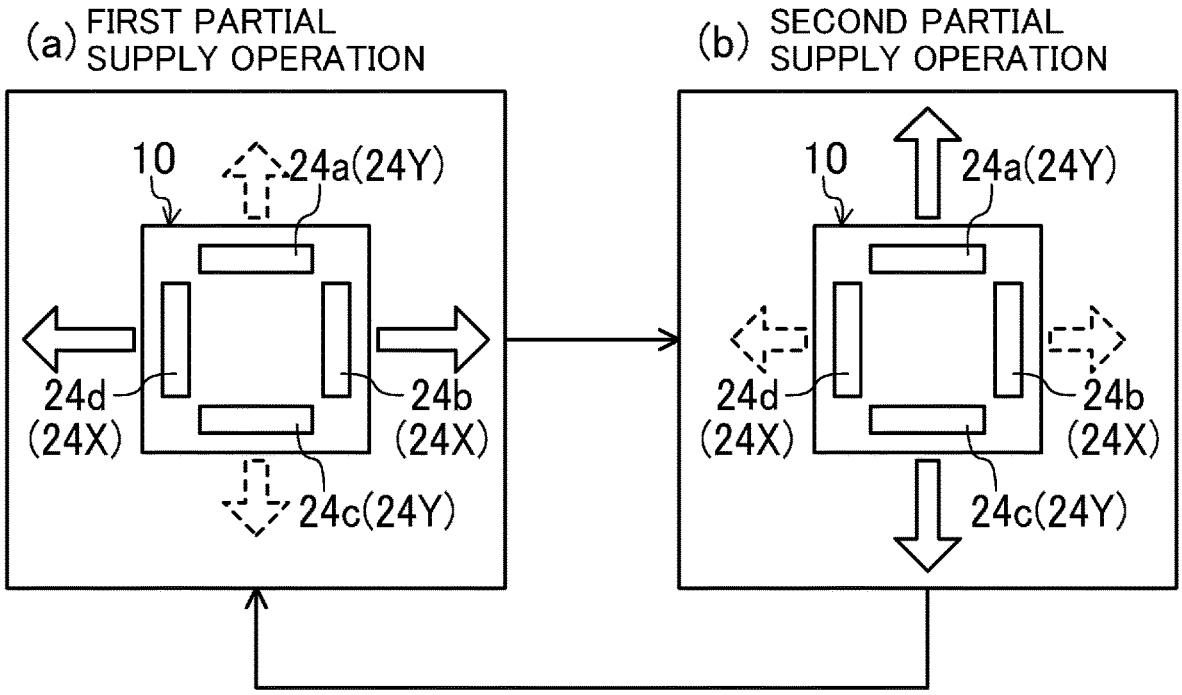
FIG. 17 is a diagram for explaining one cycle of a fifth supply mode according to a third variation, schematically showing a lower surface of the indoor unit in each operation.

Each of the indoor units (10) may be configured to be able to perform, as the airflow rotation, a fifth supply mode, in which the first and second partial supply operations are alternately performed as illustrated in FIG. 17, in addition to the first to third supply modes. In the fifth supply mode, too, the air current is stopped blowing from one of the main outlet openings (24*a* to 24*d*) facing each other with a predetermined distance α interposed therebetween during the first and second partial supply operations.

Fourth Variation of Embodiment

The controller (70) may be configured to automatically select various supply modes as the airflow rotation. For example, the controller (70) may determine which supply modes are to be performed as the airflow rotation, using an actual temperature of the floor of the indoor space (500).

Fifth Variation of Embodiment

The angle of the airflow direction adjusting flap (51), while taking the horizontal airflow position, with respect to the horizontal direction may be finely adjusted as necessary, according to the distance from the location of the indoor unit (10) to the wall surface of the indoor space (500), so that the air coming from the main outlet opening (24*a* to 24*d*) can reach the vicinity of the wall of the indoor space (500). The distance from the location of the indoor unit (10) to the wall surface of the indoor space (500) may be measured and input to the controller (70) at the installation of the indoor unit (10) in the indoor space (500) by a worker who installs the indoor unit (10). Alternatively, a sensor for detecting the distance may be attached to the indoor unit (10) in advance.

Sixth Variation of Embodiment

The indoor unit (10) is not limited to the ceiling embedded type. The indoor unit (10) may be of a ceiling suspended type or of a wall hanging type.

Note that in the ceiling mounted type and the wall hanging type, air may be supplied slightly upward, using the Coanda effect, with respect to the horizontal air current in the case of the ceiling embedded type during the operation in the airflow rotation.

The indoor unit may be of a type that does not have the auxiliary outlet openings (25*a* to 25*d*).

Seventh Variation of Embodiment

The number of the main outlet openings (24*a* to 24*d*) is not limited to four, as long as a plurality of main outlet openings are provided.

Eighth Variation of Embodiment

The indoor unit (10) may have a shutter for closing the main outlet opening (24*a* to 24*d*) as an airflow blocking mechanism in addition to the airflow direction adjusting flap (51). Preferably, in this case, the airflow blocking mechanism is provided to correspond to each of the main outlet openings (24*a* to 24*d*). For example, the airflow blocking mechanism may be configured as an open/close shutter.

Ninth Variation of Embodiment

The number of indoor units (10) included in the air-conditioning system (1) is not limited to two or four, as long as two or more indoor units are provided.

Tenth Variation of Embodiment

The airflow direction adjusting flaps (51) may be configured to close the main outlet openings (24*a* to 24*d*), instead of taking the airflow blocking position, during the partial supply operation. In this configuration, since the main outlet openings (24*a* to 24*d*) are closed, blowing of the air current from the main outlet openings (24*a* to 24*d*) are more reliably stopped during the partial supply operation, compared with the case in which the airflow direction adjusting flap (51) takes the airflow blocking position.

In this example, the airflow direction adjusting flap (51) takes a predetermined position to block the air coming from the main outlet openings (24*a* to 24*d*) during the partial supply operation.

Eleventh Variation of Embodiment

The number of main outlet openings (24*a* to 24*d*) per indoor unit at which the air current is blocked during the partial supply operation is not limited to two, and may be one or three.

Twelfth Variation of Embodiment

The control in which the air current is stopped blowing from one of the main outlet openings (24*a* to 24*d*) facing each other with a predetermined distance $\alpha$ interposed therebetween may be carried out not during the airflow rotation but during a period in which only the partial supply operation is performed.

INDUSTRIAL APPLICABILITY

As can be seen from the foregoing description, the present invention is useful as an air-conditioning system having a plurality of indoor units installed in a ceiling.

DESCRIPTION OF REFERENCE CHARACTERS

1 Air-Conditioning System
10 Indoor Unit
20 Casing (Indoor Casing)
24*a* to 24*d* Main Outlet Opening (Outlet Opening)
50 Airflow Blocking Mechanism
51 Airflow Direction Adjusting Flap
70 Controller
500 Indoor Space

The invention claimed is:

1. An air-conditioning system, comprising:

a plurality of indoor units installed in a ceiling of an indoor space, the plurality of indoor units each having an indoor casing having a rectangular lower surface, first to fourth outlet openings arranged such that one outlet opening is provided along one of four sides of the lower surface, and an airflow blocking mechanism provided at each of the outlet openings and configured to block an air current, the plurality of indoor units being spaced from each other by a predetermined distance in a horizontal direction; and a controller which controls the airflow blocking mechanisms in the plurality of indoor units, the controller being configured to perform a partial supply operation in which, in each of the indoor units, the air current coming from one or some of the outlet openings is blocked by the airflow blocking mechanism, thereby increasing a speed of the air current coming from the rest of the plurality of outlet openings, the partial supply operation including a first partial supply operation in which the airflow blocking mechanism blocks air blown from the first outlet opening and the third outlet opening, and a second partial supply operation in which the airflow blocking mechanism blocks air blown from the second outlet opening and the fourth outlet opening, two adjacent indoor units positioned at the predetermined distance from each other, one of the two adjacent indoor units being a first indoor unit, and another one of the two adjacent being a second indoor unit, the second outlet opening of the first indoor unit facing the fourth outlet opening of the second indoor unit, and control, in the partial supply operation, the airflow blocking mechanism of the first indoor unit and the second indoor unit such that one of the first indoor unit or the second indoor unit performs the first partial supply operation, and the other performs the second partial supply operation to prevent air current from being blown from one of the second outlet opening of the first unit or the fourth outlet opening of the second unit.

2. The air-conditioning system of claim 1, wherein each of the indoor units further has an airflow direction adjusting flap provided at a corresponding one of the outlet openings and configured to change a direction of air blown from the corresponding one of the outlet openings, and the controller is further configured to control the airflow blocking mechanism and the airflow direction adjusting flap in order to perform an airflow rotation in which a full supply operation supplying air to the indoor space from all of the outlet openings and the partial supply operation are alternately performed.

3. The air-conditioning system of claim 2, wherein the airflow direction adjusting flap is capable of shifting to a position where the air current blown from the corresponding one of the outlet openings is blocked, and also serves as the airflow blocking mechanism.

4. The air-conditioning system of claim 3, wherein the airflow direction adjusting flap closes the corresponding one of the outlet openings in the partial supply operation.

* * * * *